United States Patent [19]

Lucas

[11] 4,000,916

[45] Jan. 4, 1977

[54] MANIFOLD REPORT FORM AND METHODS FOR USING THE SAME

[75] Inventor: Roland T. Lucas, Milwaukee, Wis.

[73] Assignee: St. Luke's Hospital Research Foundation, Inc., Milwaukee, Wis.

[22] Filed: Feb. 18, 1975

[21] Appl. No.: 550,702

Related U.S. Application Data

[63] Continuation-in-part of Ser. No. 420,645, Nov. 30, 1973, abandoned.

[52] U.S. Cl. ..... 282/11.5 A; 282/22 R; 282/24 R

[51] Int. Cl.[2] ..... B41L 1/20

[58] Field of Search ..... 282/22 R, 24 R, 24 A, 282/24 B, 24 C, 23 R, 11.5 R, 11.5 A; 101/473

[56] References Cited

UNITED STATES PATENTS

| | | | |
|---|---|---|---|
| 2,020,287 | 11/1935 | Bonn | 282/22 R |
| 2,042,823 | 6/1936 | Bonn | 282/22 R |
| 2,100,814 | 11/1937 | Morrison | 282/24 A |
| 2,360,142 | 10/1944 | Kerr | 282/24 R |
| 2,802,678 | 8/1957 | Bright | 282/22 R |

FOREIGN PATENTS OR APPLICATIONS

| | | | |
|---|---|---|---|
| 1,172,283 | 6/1964 | Germany | 282/22 R |

*Primary Examiner*—Jerome Schnall
*Attorney, Agent, or Firm*—James E. Nilles

[57] ABSTRACT

A manifold report form, originally provided in the form of a continuous web comprising serially connected detachable forms and adapted to have data entered upon the front and back sides thereof by imprinting or writing, and methods of using or processing the form are disclosed. The form comprises three superimposed coextensive record sheets (top, middle and bottom) upon which data is to be entered, two sets of carbon papers for entering data from the originally imprinted record sheets to the record sheet copies, and two protective tissue paper sheets to prevent data being entered on the front side of the form during the first imprinting or writing from appearing on the back side of the record sheets. The first original imprinting appears on the front side of the top sheet and the second original imprint appears on the back side of the bottom sheet. In using the form it is necessary to remove the first set of carbon papers and both protective sheets after the first imprinting and to remove the remaining second set of carbon papers after the second imprinting to provide the completed record sheets. Such removal can be done manually by a snap-out procedure with each individual form or automatically by a decollating machine when processing the forms in a continuous web.

1 Claim, 19 Drawing Figures

FS
BS
10
12
14
14A
14B
14C
15
16
17
18
18A
18B
18C
19
24
26
28
30
32
A
A1
A2
B
B1
B2
C
C1
C2
C3
C4
C11
C12
T1
T2

MANIFOLD REPORT FORM AND METHODS FOR USING THE SAME

This is a continuation-in-part of U.S. Ser. No. 420,645, filed Nov. 30, 1973, now abandoned.

BACKGROUND OF THE INVENTION

1. Field of Use

This invention relates generally to a manifold report form which is adapted to have data entered by imprinting or writing upon the front and back sides thereof, and to methods for using or processing the form.

2. Description of the Prior Art

Manifold forms which are designed to provide an original and several duplicate copies are generally well known. In such forms carbon paper is placed between those pages of the form upon which data is to be entered, as by imprinting, typing or writing, and the data entered on the top sheet is reproduced on the underlying record sheets. U.S. Pat. No. 2,802,678 to Bright discloses a manifold form of the block or pad type wherein data may be entered on both the front and back surfaces of the record sheets making up the form without the need to reassemble the record sheets or rearrange the carbons. The form disclosed in Bright is intended to be used as an individual form, and its construction is such that it does not lend itself to use in automatic data processing applications. Furthermore, the form disclosed in Bright, even if used individually, does not provide for certain advantages and conveniences, particularly as regards the removal of the carbon papers and guard sheets during the various stages of the use of the form.

SUMMARY OF THE INVENTION

A manifold report form, adapted to have data entered by imprinting or writing upon the front and back sides thereof, and methods for using or processing the form are disclosed. A plurality of forms are serially connected in a continuous web from which each form can be separated. Each form comprises three superimposed and coextensive record sheets, namely top, middle and bottom record sheets, and each record sheet has corresponding information lines or areas on its front surface and on its back surface. In each form the opposite lateral side edges of all of the record sheets are mechanically joined together by gluing, and each record sheet is provided with perforate tear lines parallel to the opposite lateral side edges to define first and second tear strips along the lateral side edges of the record sheets. Each tear strip is provided with longitudinally spaced apart pin feed holes for guiding the forms and the web of which they are part through web-processing machinery such as computer-fed automatic printers, decollators and bursters in accordance with the methods of the invention. A first set of carbon papers comprising two first sheets of carbon paper is arranged so that one sheet of first carbon paper is positioned face-down (carbon side down) between each preceding and succeeding record sheet for reproducing data written or printed on the front side of the top record sheet on the front sides of the middle and bottom record sheets. A second set of carbon papers comprising two sheets of second carbon paper is arranged so that one sheet of second carbon paper is positioned face-up (carbon side up) between each sheet of first carbon paper and the preceding (uppermost) record sheet for reproducing data written or printed on the back side of the bottom record sheet on the back sides of the middle and top record sheets. A sheet of protective tissue paper is positioned between each sheet of second carbon paper and the preceding (uppermost) record sheet for preventing reproduction of data written or typed on the front side of the top record sheet from appearing on the back sides of the top and middle record sheets. The first set of carbon papers and the tissue papers are secured along one edge to the first tear strip as by gluing, and the second set of carbon papers are secured along one opposite edge to the second tear strip as by gluing.

The form may be used or processed in either of two ways, i.e., individually or in web form. When used individually, a single form is detached from the web and the first set of carbons and both protective tissues are removed as a single connected unit manually by a snap-out procedure after the front side of the form is imprinted and the second set of carbons is subsequently removed as a single connected unit manually by a snap-out procedure after the back side of the form is printed, leaving the three record sheets as discrete disconnected elements. When used in web form, the first set of carbon papers and the protective tissues are removed as continuous webs by a decollating machine after the first imprinting and subsequently the second set of carbon papers are removed as continuous webs by a decollating machine after the second imprinting.

The form is so constructed and processed that the original data is entered on the front surface of the top record sheet and the back surface of the bottom record sheet.

When handling the forms in a continuous web, a final processint step of bursting can produce three separate stacks of discrete disconnected top, middle and bottom record sheets ready for distribution. Or, if preferred, a final processing step omitting bursting can produce three separate stacks of top, middle and bottom record sheets, with the sheets in each stack still connected as a continuous web.

Other objects and advantages of the invention will hereinafter appear.

DRAWINGS

Figure 11A:
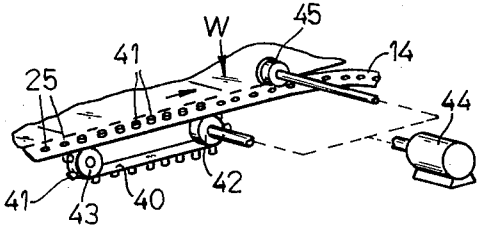
FIG. 11A is a side elevation view of a portion of a pin feed mechanism which is used on printers, decollators and bursters to advance the web therethrough for processing.
Figure 11:
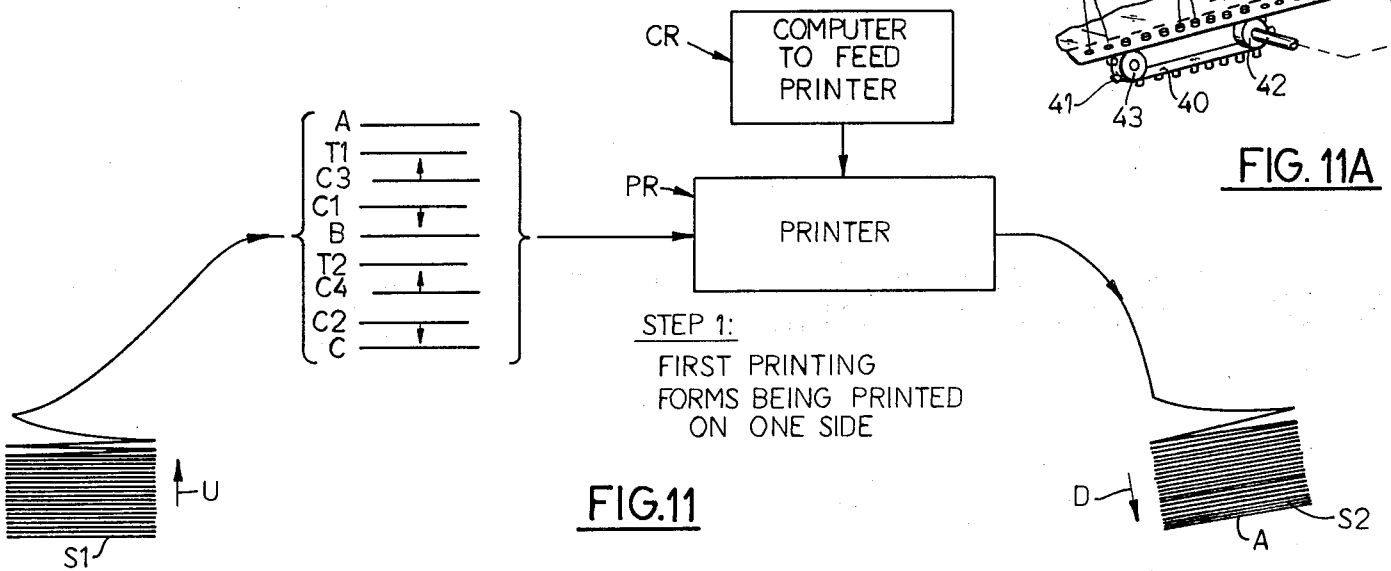
FIG. 11 is a schematic diagram showing a web comprising serially interconnected forms of the invention undergoing a first imprinting operation.
Figure 17:
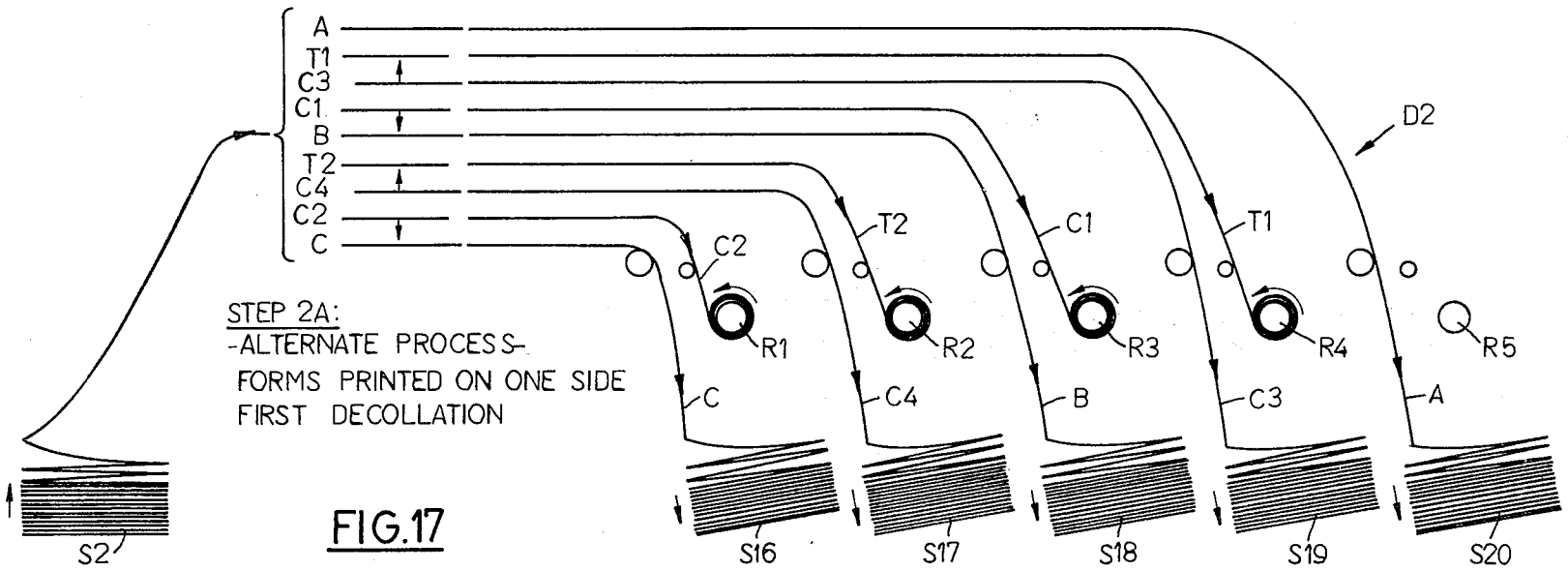
Figure 18:
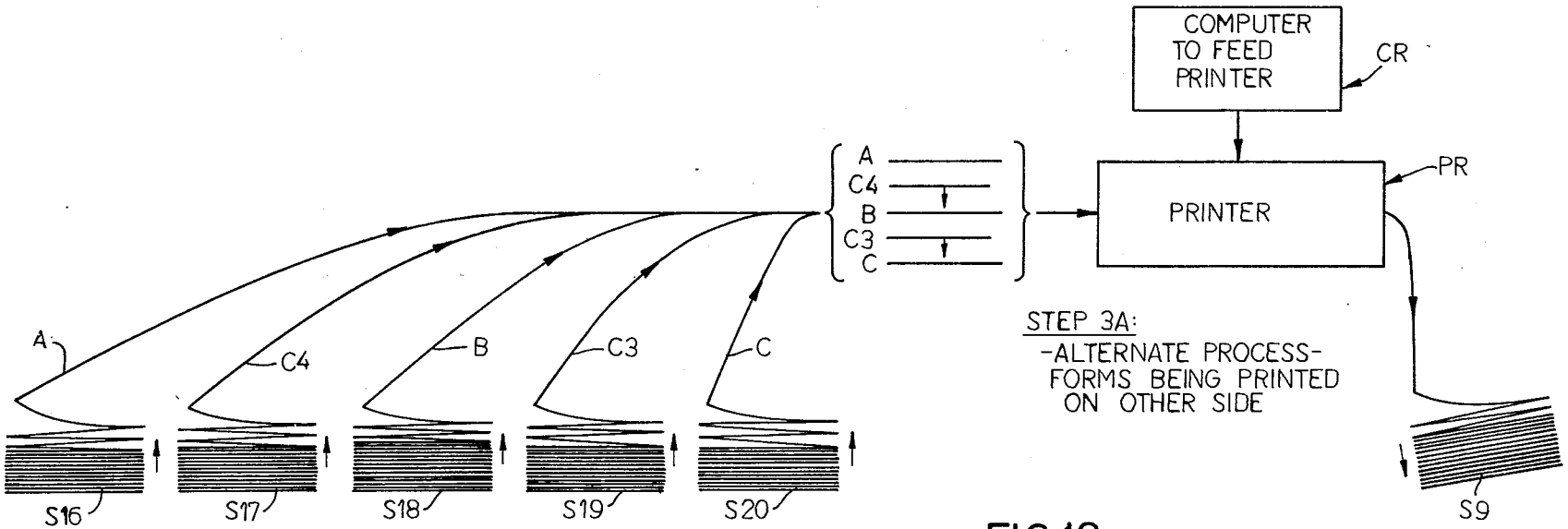

FIG. 17 is a schematic diagram showing an alternate method of processing wherein a continuous web comprising forms which have been imprinted on the first side, as shown in FIG. 11, undergoes an alternate first decollating process, being processed by another type of decollator machine; and FIG. 18 is a schematic diagram showing the alternate method of processing wherein the web comprising the forms is undergoing a second imprinting operation.

Description of the Invention

Figure 1:
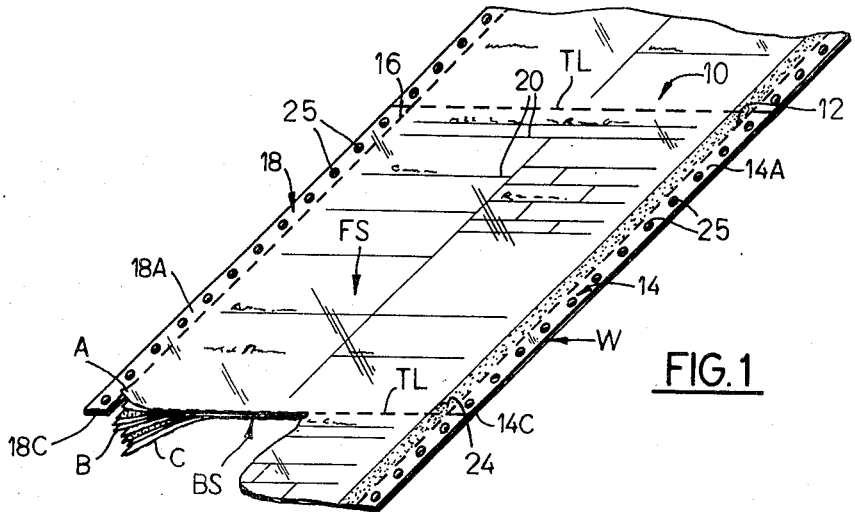
FIG. 1 is a perspective view of a manifold form of the present invention shown as part of a series of interconnected detachable similar forms in a continuous web.
Figure 2:
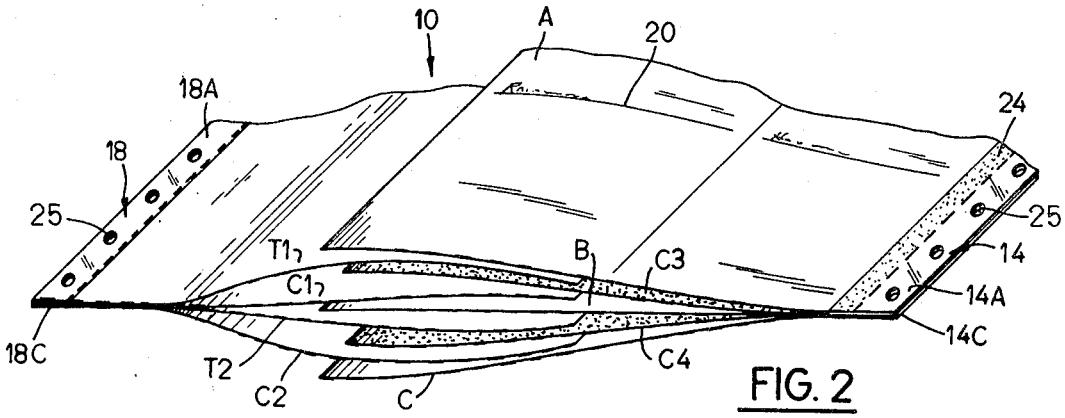
FIG. 2 is a perspective view of a portion of a single form showing the first set of carbon papers and protective tissue papers being removed from the form by a snap-out procedure.

Referring to FIG. 1, there is shown a manifold report form 10, originally provided in the form of a continuous web W and adapted to have data entered upon the front side FS and the back side BS thereof by imprinting or writing. Adjacent forms 10 in web W are detachably interconnected along transverse perforated tear lines TL at the top and bottom edges of the forms. Methods of using or processing an individual detached form 20 manually by a snap-out process are disclosed in FIGS. 2 through 8. Methods of using or processing the forms automatically are disclosed in FIGS. 9 through 18. The form 10 comprises three superimposed coextensive record sheets A, B and C (top, middle and bottom), respectively, upon which data is to be entered, two sets of carbon papers (set C1, C2 and set C3, C4) for entering data from the originally imprinted record sheets to the record sheet copies, and two protective tissue paper sheets T1 and T2 to prevent data being entered on the front side FS of the form 10 during the first imprinting or writing from appearing on the back sides A2 and B2 of the record sheets A and B, respectively. The first original imprinting appears on the front surface A1 of the top record sheet A, and the second original imprint appears on the back surface C12 of the bottom record sheet C. In using the form 10, either manually or in automatic processing, it is necessary to remove the first set of carbon papers C1, C2 and both protective sheets T1, T2 after the first imprinting and to remove the remaining second set of carbon papers C3, C4 after the second imprinting to provide the completed record sheets A, B and C. Such removal can be done manually by a snap-out procedure with each individual form 10, as shown in FIGS. 2 through 8, or automatically by a decollating machine when processing the forms 10 in a continuous web W, as shown in FIGS. 9 through 18.

Figure 3:
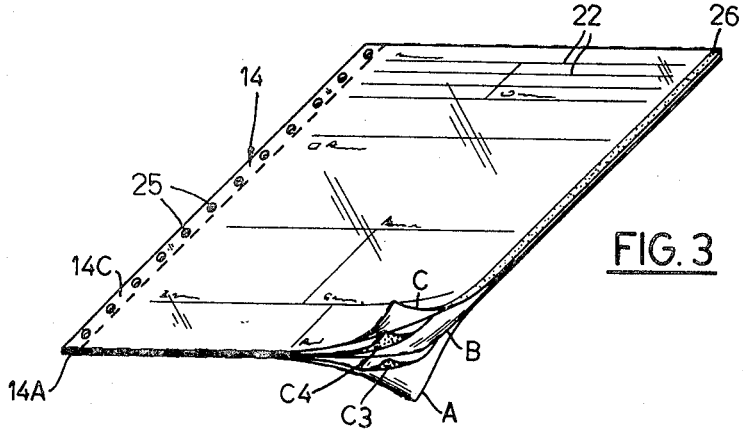
FIG. 3 is a perspective view of a single form turned over or reversed for recording information on the back side of the form.

The manifolded report form 10 of the present invention includes three record sheets A, B and C. As FIG. 4 makes clear, the record sheets A, B and C are mechanically joined together or connected along both their lateral side edges as by gluing. Each record sheet is perforated on a line 12 along one lateral side edge to provide tear strips 14A, 14B and 14C. Each record sheet is also perforated on a line 16 along the other side edge to provide a second set of tear strips 18A, 18B and 18C. Each of the data sheets A, B, C is provided with a first set of form lines 20, shown in FIG. 1, on its top page or front surface A1, B1, C11, respectively, and a second set of form lines 22, shown in FIG. 3, is provided on the bottom page or back surface A2, B2, C2, respectively. Both sets of form lines 20 and 22 extend transversely to the tear strips 14A, B and C and 18A, B and C. Tear strips 14 and 18 have longitudinally spaced pin feed holes 25 therein.

Material written on the lines 10 (or in the spaces therebetween) on top page A1 of sheet A can be duplicated on the corresponding lines 20 on the other top record pages B1 and C11 of sheets B and C, respectively, by means of a first set of carbon papers C1 and C2 interposed between the record sheets A and B and B and C, respectively. The side edges 15 of the carbon papers C1 and C2 extend beyond the perforated line 16 and are secured to the tear strips 18A, 18B and 18C.

Figures 4, 5, 6:
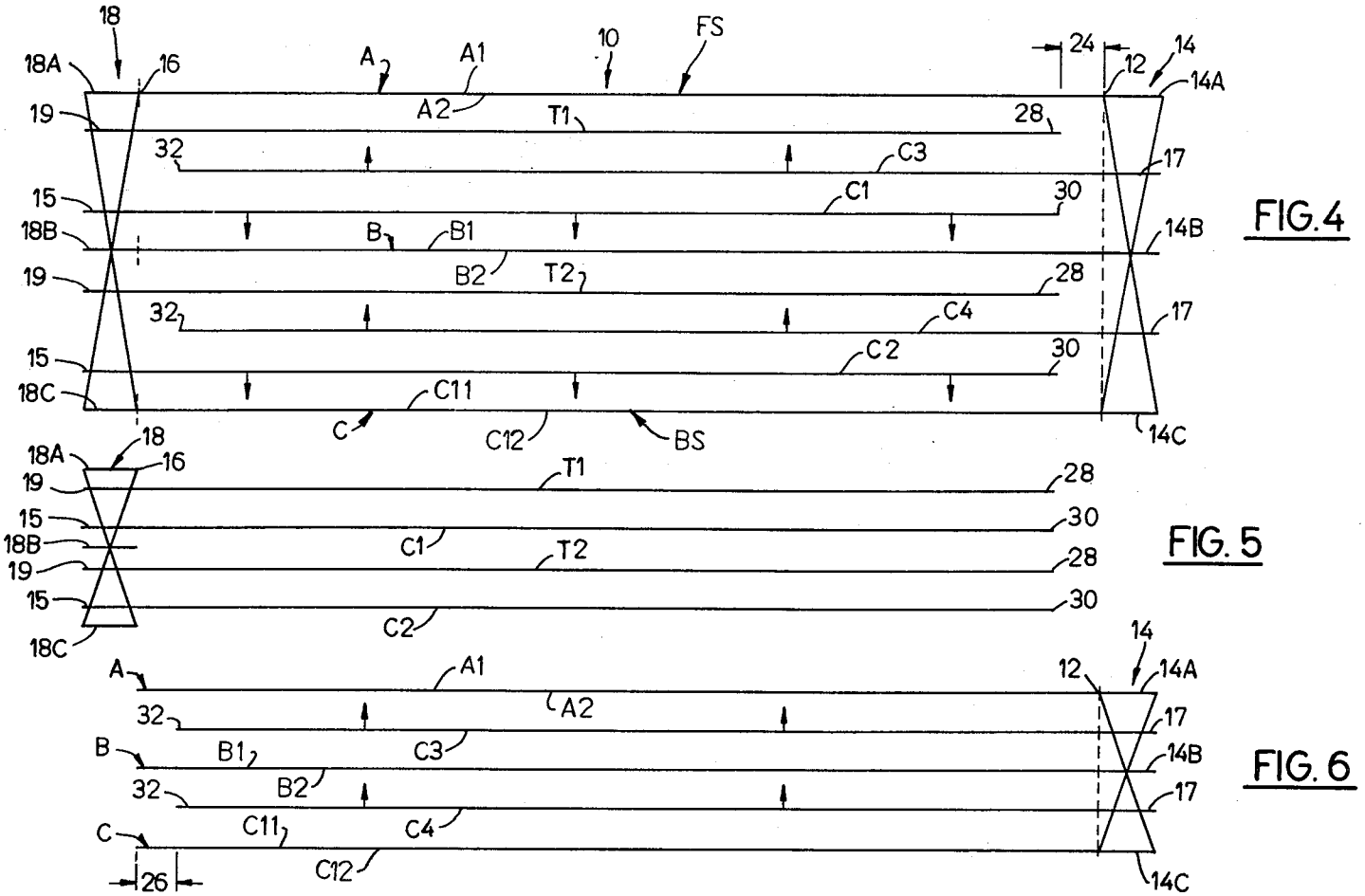
FIG. 4 is a schematic end view of the complete form showing the position of the manifolded record sheets, carbon papers and protective tissue papers.
FIG. 5 is a schematic end view of the first set of carbon papers and tissue papers after removal as a unit by a snap-out procedure from the form.
FIG. 6 is a schematic end view of the form showing the position of the record sheets and second set of carbon papers prior to being turned over for recording on the back of the form.

Material written on the lines 22 (or in the spaces therebetween) on the back or bottom record page C12 of the bottom data sheet C can be duplicated on the corresponding lines 22 on the bottom record pages B2 and A2 of sheets B and A, respectively, by means of carbon papers C3 and C4. In this regard, as FIG. 4 shows, the carbon paper C3 is located between the carbon paper C1 and the record sheet A. Carbon paper C4 is located between carbon paper C2 and record sheet B. The side edges 17 of the carbon papers C3 and C4 extend outwardly beyond the perforated line 12 and are connected to the tear strips 14A, 14B and 14C.

Material written on the lines 20 (or in the spaces therebetween) on the top record page A1 of sheet A is prevented from being duplicated on the lines 22 on the back pages A2 and B2 of the sheets A and B, respectively, by means of protective sheets of tissue or blank paper T1 and T2. The tissue paper T1 is interposed between the record sheets A and the carbon paper C3. The tissue paper T2 is interposed between the record sheet B and the carbon paper C4. The side edges 19 of the tissue papers T1 and T2 extend outwardly beyond the perforated line 16 and are connected to the tear strips 18A, 18B and 18C.

When assembled as shown in FIGS. 1 and 4, the data sheets A, B and C, carbon papers C1, C2, C3 and C4 and tissue papers T1 and T2 will be manifolded as shown in FIG. 4. The tear strips 18A, 18B and 18C and the side edges 15 of the carbon papers C3 and C4 and the side edges 19 of the tissue papers T1 and T2 will be secured together at one side of the manifold report to form a first unit 18 for manual removal, for example, by a snap-out process from the record sheets A, B and C. The tear strips 14A, 14B and 14C and the side edges 17 of the carbon papers C3 and C4 will be secured together along the opposite side edge to form a second unit 14 for manual removal, for example, by a snap-out process from the record sheets A, B and C.

After entries have been made on the lines 20 on the top record page A1 of sheet A, the first unit 18 which includes the tear strips 18A, 18B and 18C, the carbon papers C1 and C2 and the tissue papers T1 and T2 are removed or manually snapped out from the manifolded report form 10 (FIG. 5). The sheets A, B and C, still connected together along one edge, are then left with the carbon papers C3 and C4, still attached thereto, as shown in FIG. 6.

Figure 7:
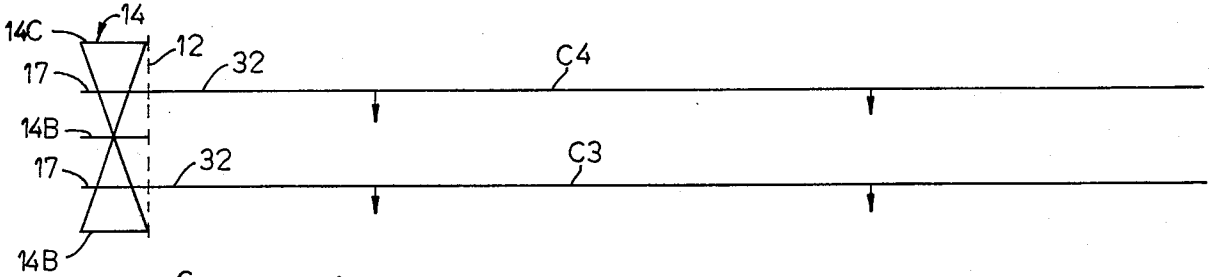
FIG. 7 is a schematic end view of the second set of carbon papers after removal as a unit by a snap-out procedure from the form.
Figure 8:
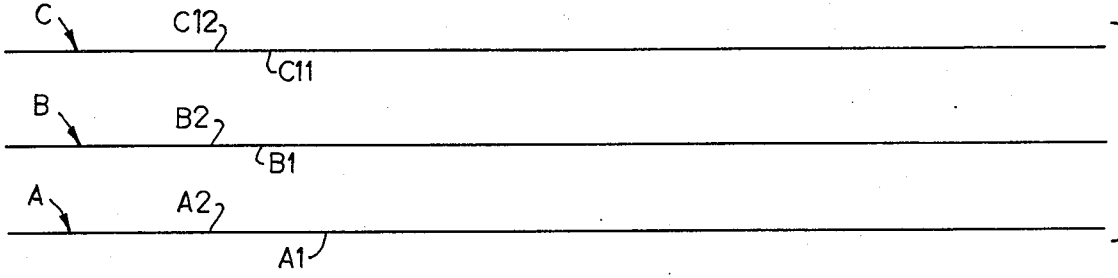
FIG. 8 is a schematic end view of the remaining detached record sheets after both sides of the form have been imprinted and both sets of carbon papers and protective tissues have been removed.

The record is completed by turning the remaining manifolded sheets over as shown in FIG. 3. The sheet C will now be on the top and the tear strips 14C, 14B and 14A will be on the left, as shown in FIGS. 3 and 7. Since the tissue papers T1 and T2 have now been removed, material written on the lines 22 on the bottom record page C12 of sheet C can be duplicated onto the corresponding lines on the bottom record pages B2 and A2 of sheets B and A, respectively. After the record is completed, the second unit 14 which includes the tear strips 14A, 14B and 14C and the carbon papers C3 and C4 are removed or manually snapped out from the form 10 (FIG. 7) and the sheets A, B, C remain in disconnected form (FIG. 8).

Means are provided for preventing both units 14 and 18 from being removed simultaneously from the manifolded report form 10. Such means is in the form of a double perforation being provided in line 16 with respect to line 12. The double perforation reduces the strength of the line 16 so that line 16 will tear easier than line 12.

A further safeguard has been provided by imprinting a shaded border 24 on page A and a shaded border 26 on page C. The ends 28 of the tissue paper T1 and T2 and the ends of the carbon paper C1 and C2 are cut short so that they terminate a distance short of the tear strips 14 equal to the width of shaded border 24. The ends 32 of the carbon papers C3 and C4 terminate a distance short of the tear strips 18 equal to the width of the shaded border 26.

When the first unit 18 is to be removed from the manifolded report, the user preferably grips the sheets A, B and C on the shaded border 24 (although the tear strip areas alone may be grasped) and pulls tear strips 18A, 18B and 18C, the carbon papers C1 and C2 and tissue papers T1 and T2 as a unit from the report. When the second unit 14 is to be removed from the report sheets A, B and C, the user grips the shaded border 26 and pulls tear strips 14A, 14B and 14C as well as carbon papers C3 and C4 from the report sheets A, B and C. By gripping the manifolded report on the shaded borders 24 and 26, the first and second units can be removed easily since the side edges 28 of the tissue paper and the side edges 30 and 32 of the carbon papers terminate short of the shaded borders.

Figure 9:
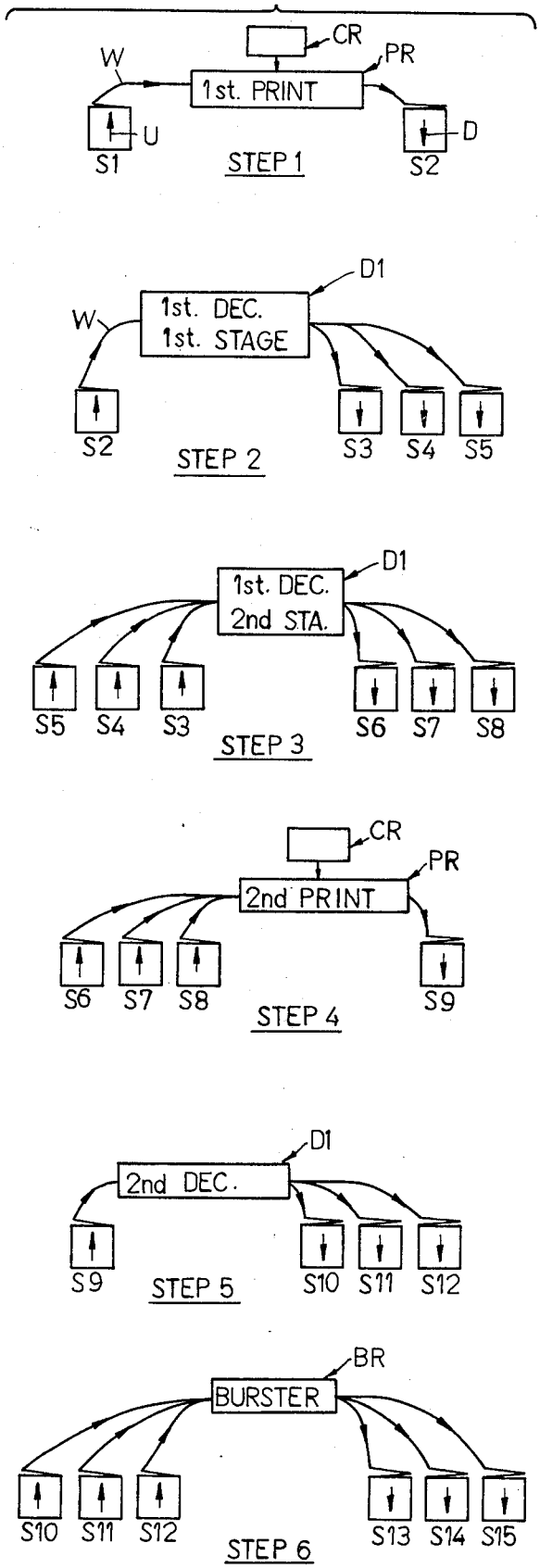
FIG. 9 is a flow chart showing steps in automatically processing the form in accordance with a first series of method steps.
Figure 10:
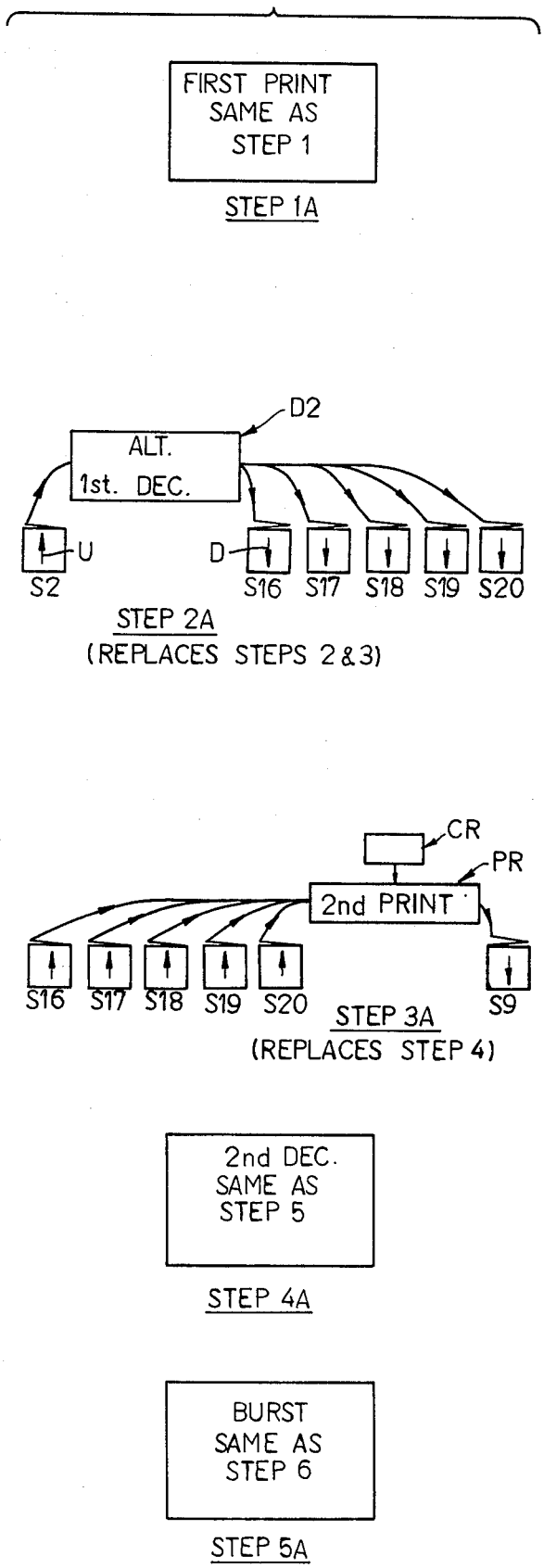
FIG. 10 is a flow chart showing steps in automatically processing the form in accordance with a second or alternate series of method steps.

The procedures thus far described are applicable to removal of the carbon papers and protective sheets when an individual form 10 is removed or detached by tearing from the web W. However, the forms 10 are especially well suited for use or processing in the form of a continuous web W. In automatic processing of the forms 10 in web W it is contemplated that the web W be fed through an automatic printer PR which receives input or data from a computer CR. After the forms 10 are printed on one side, certain of the carbon papers and the protective tissues are removed by a decollating machine (D1 or D2), whereupon the forms 10 in web W are again fed through the printer PR so that data may be entered on the opposite side of the forms 10. After the forms 10 in web W have been printed on both sides, the remaining carbon papers are removed by the decollator D1 or D2 and the forms 10 in web W are fed through a burster machine which breaks the web W up into stacks of discrete forms, each printed on both sides and ready for distribution. FIG. 9 shows a series of six processing steps for carrying out the aforedescribed automatic processing of web W, and FIG. 10 shows an alternate series of processing steps for web W. Referring to FIG. 9, the processing steps 1, 2, 3, 4, 5 and 6 correspond to the processing steps which are shown in greater detail in FIGS. 11, 12, 13, 14, 15 and 16, respectively. Referring to FIG. 10, five processing steps 1A, 2A, 3A, 4A and 5A are shown. In FIG. 10 the processing steps 1A, 4A and 5A correspond to the steps 1, 5 and 6, shown in FIG. 9. The processing step 2A shown in FIG. 10 replaces steps 2 and 3 shown in FIG. 9 and involves feeding the web W through a decollating machine D2 which has more carbon paper removal stations than the decollating machine D1 shown in FIG. 9 and elsewhere. The processing step 3A shown in FIG. 10 involves printing web W on the reverse side, but contemplates the use of the same type of computer CR and printer PR as is used in the process shown in FIG. 9. The processing steps 2A and 3A shown in FIG. 10 correspond to the FIGS. 17 and 18, respectively.

Figure 12:
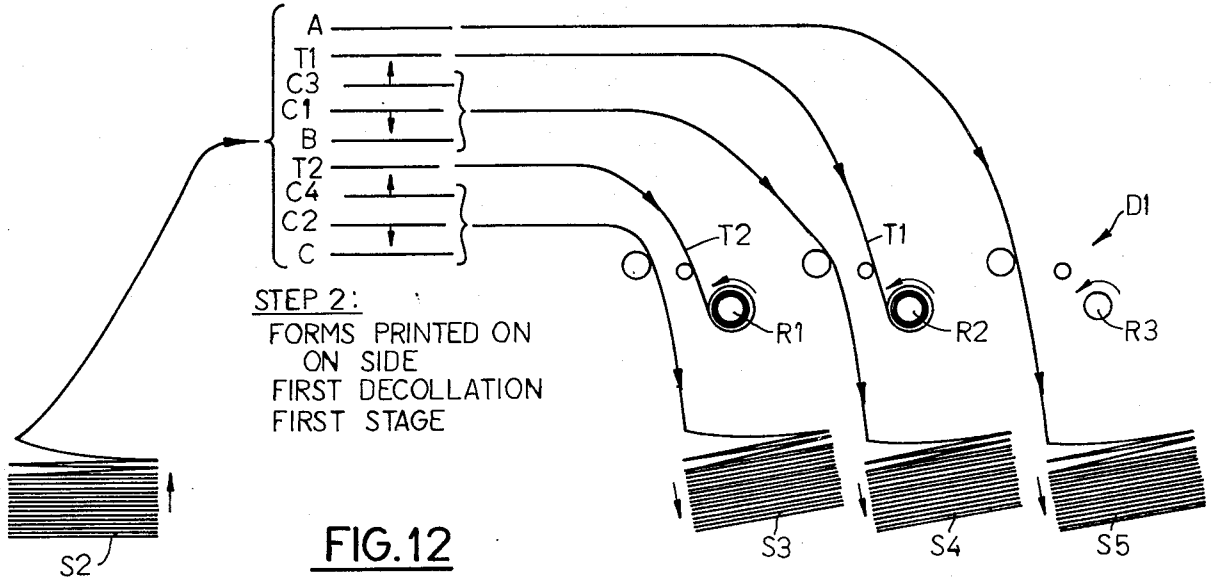
FIG. 12 is a schematic diagram showing a web comprising the forms which have been imprinted on the first side undergoing the first stage of a first decollating process whereby the protective tissues are removed.

The printer PR shown in the drawings is an automatic electric typewriter, such as a Telex Model 5403 printer, and the printer is fed with data or information which is to be entered on the forms 10 by an input or computer CR which, for example, may take the form of an IBM System 360 computer. The printer PR and the computer CR are conventional and known types of apparatus. A decollator machine D1, shown in FIG. 9 and in those figures related to FIG. 9, may take the form of a Model 284 Decollator manufactured by the Moore Business Forms Company and has motor driven spindles R1, R2, R3. The decollator D2 shown in FIG. 10 is similar to the decollator D1 except that it has two additional spindles R4 and R5 for removing or winding carbon paper. As FIG. 12 shows, the decollator machine D1 has three stacking compartments into which stacks of interconnected foldable forms are directed and further comprises three rewind spindles designated R1, R2 and R3, which function as hereinafter explained. The decollator D2 has five stacking compartments and two additional rewind spindles R4 and R5. It is also to be understood that the decollating machines D1 and D2, the printer PR and the burster BR are each provided with a pair of laterally spaced apart pin feed mechanisms, such as shown in FIG. 11A, by means of which, for example, an endless chain 40 having a plurality of pins 41 thereon is driven around rollers 42 and 43 by means of an electric motor 44 which is part of the machine in which the pin feed mechanism is incorporated. The pins 41 are engageable with the pin feed holes 25 which are provided in the lateral side edges or the tear strips of form 10. The pins 41 guide, align and transport the web W through the various processing machines. Motor 44 may also be adapted to drive a rotary slitter blade or knife 45 which is selectively unable to cut the tear strips 14 and 18 from the forms 10 in web W during certain steps in processing. The burster BR may take the form, for example, of a Selectronic burster such as is manufactured and sold by the Standard Register Company of Dayton, Ohio. The burster is a conventional, well known type of machine which is adapted to cut web W into discrete forms along the transverse tear lines TL, to remove any remaining tear strip on the forms, and to stack the record sheets A, B and C in separate piles or stacks for distribution.

Figure 13:
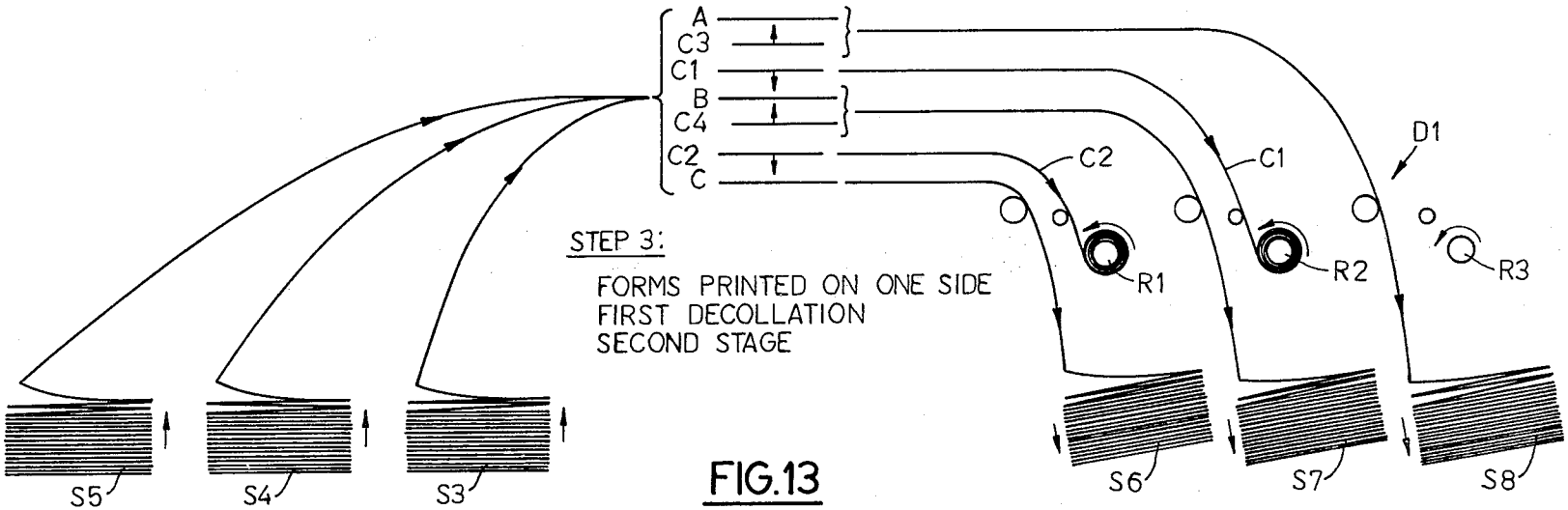
FIG. 13 is a schematic diagram showing a web comprising the forms imprinted on the first side undergoing the second stage of the first decollating process.
Figure 14:
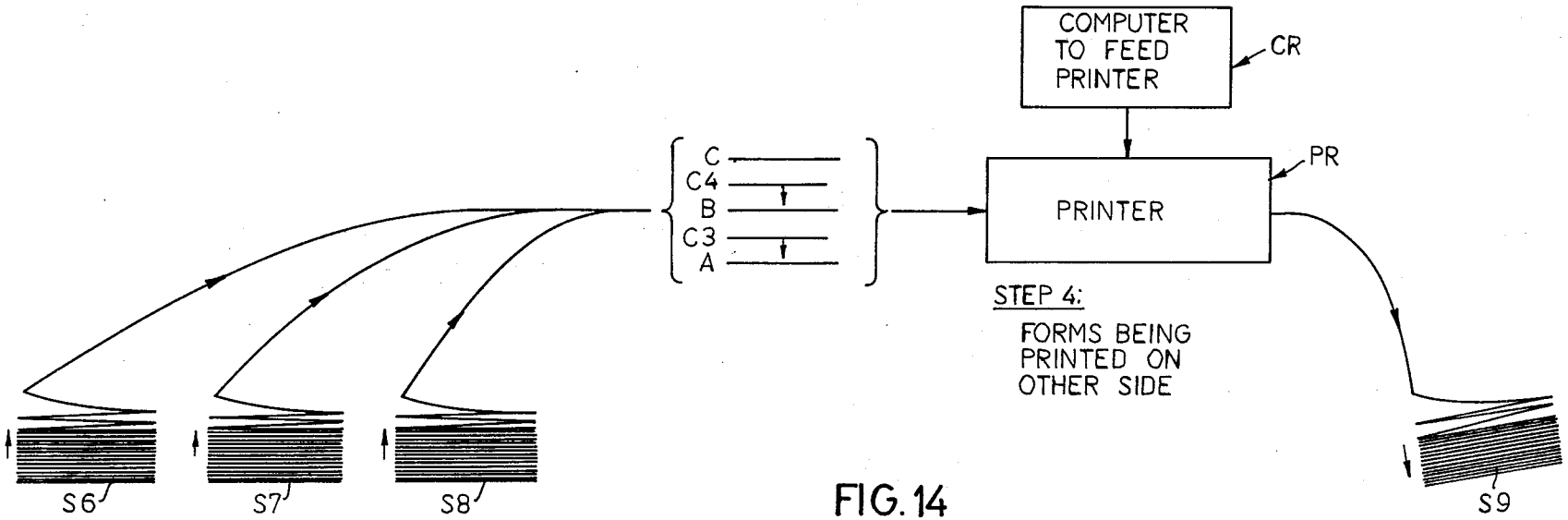
FIG. 14 is a schematic diagram showing a web comprising the forms of the invention undergoing a second imprinting operation.
Figure 15:
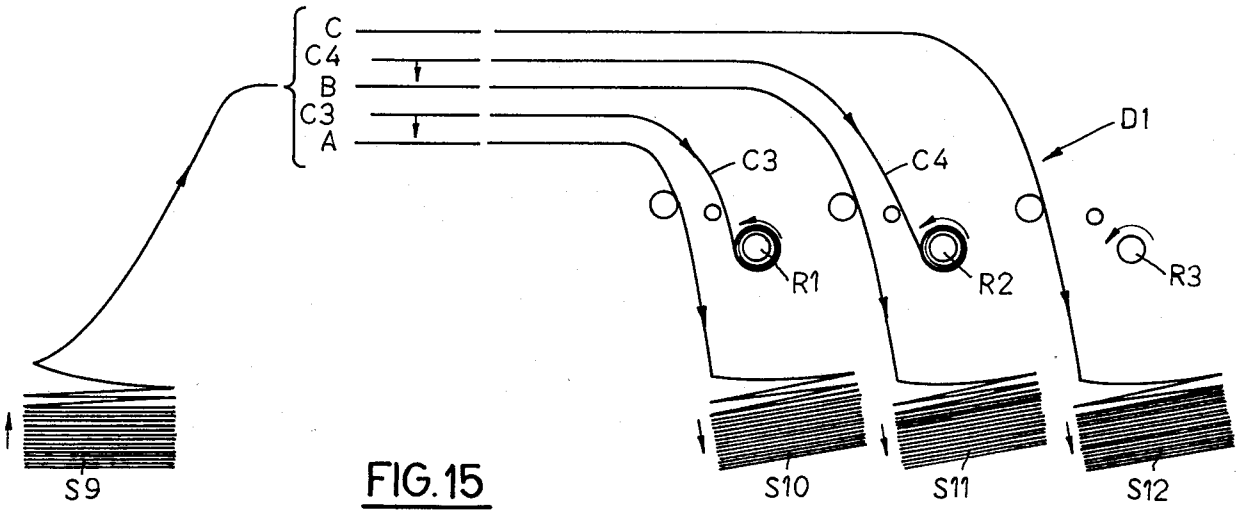
FIG. 15 is a schematic diagram showing a web comprising the forms which have been imprinted on both sides undergoing a second decollating process.
Figure 16:
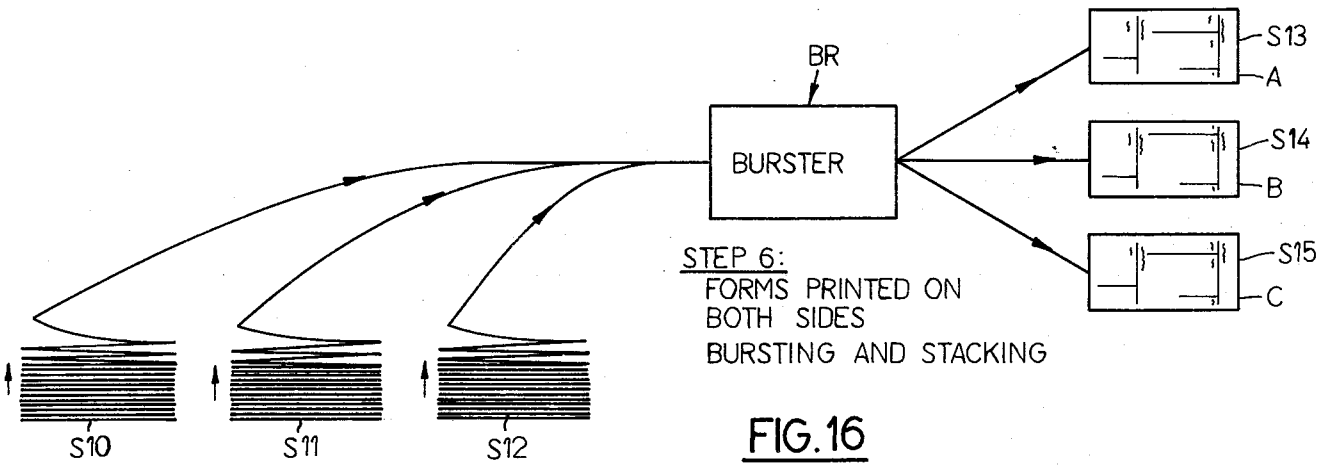
FIG. 16 is a schematic diagram showing a processing step wherein the web comprising serially connected forms imprinted on both sides is being sent through a burster which separates the forms from the web and arranges the discrete independent record sheets into separate stacks.

The process of series of method steps shown in FIG. 9 will now be described. Assume that the forms 10 in the form of a web W are provided in the form of a folded stack S1. For purposes of orientation the hereinafter identified stacks shown in FIGS. 9 and 10 each encompass an arrow designated U in those cases where the arrow points upward and designated D in those instances where the arrow points downward. The arrow U indicates that the stack is upright, and the arrow D indicates that the stack is upside down. In those cases where a stack is upright, as indicated by the arrow U, the top side of the top form in the stack will present the record sheet A with its upper surface A1 uppermost for processing by the processing machinery. Referring to FIG. 9, Step 1, it is seen that the web W is fed to printing machine PR for a first imprinting, and the forms are fed into the printer PR upright and emerge from the machine to form an upside down stack S2 in which all forms in web W have been imprinted on one side. In Step 2 of FIG. 9 the stack S2 is reversed so that it is again upright, and the web W is fed to decollator D1 for the first stage of a first decollation process wherein, as FIG. 12 shows, the tissue papers T1 and T2 are removed and stacks S3, S4 and S5 are provided. Removal of the protective tissues T1 and T2 is accomplished in decollator D1 by splitting the glue in tear strips 14 and 18 when the web W is fed into the decollator D1 so as to free the attached edges of the tissues T1 and T2 which, as FIG. 4 shows, are attached only at one edge. As FIG. 12 shows, the stacks S3, S4 and S5 of FIGS. 9 and 12 comprise constituent elements of form 10 as grouped in FIG. 12. After Step 2 of FIG. 9 is completed the stacks S3, S4 and S5 are reversed and rearranged so that they are in the disposition and order shown in Step 3 of FIG. 9. Step 3 in FIG. 9 corresponds to FIG. 13. In Step 3 there is shown the second stage of the first decollation process wherein the carbons C1 and C3 are removed by the spindles R2 and R1, respectively, of the decollator D1. Upon completion of Step 3, stacks S6, S7 and S8 remain and contain the constituent elements as shown in FIG. 13. To proceed from Step 3 to Step 4 of FIG. 9 it is necessary to reverse the stacks S6, S7 and S8 and feed them through the printer PR for the second printing of the forms 10 in web W, i.e., the printing on the reverse side. Upon completion of Step 4 of FIG. 9 a single stack S9, upside down, is presented. As FIG. 9 shows, in proceeding from Step 4 to Step 5 the stack S9 is tipped over and the second decollation step, shown in detail in FIG. 15, is carried out on stack S9, thereby providing three separate stacks S10, S11 and S12. In Step 5 of FIG. 9 (FIG. 15) the carbon papers C3 and C4 are removed by the spindles R1 and R2, respectively, of decollator D1. In proceeding from Step 5 to Step 6 of FIG. 9, the stacks S10, S11 and S12 are inverted so as to be upright, and the remaining components, namely, the record sheets A, B and C, are fed through burster BR, whereupon the remaining elements of form 10 are cut into discrete record sheets and arranged in three separate stacks S13, S14 and S15. The forms in the stacks S13, S14 and S15 are ready for distribution as required.

Referring to FIG. 10, there is shown an alternate procedure for processing the forms 10 in web W. In FIG. 10 the Step 1A is identical to the Step 1 in FIG. 9. The Step 2A in FIG. 10 involves presentation of stack S2 to a first decollation step by means of decollator D2 (see FIG. 17) wherein the tissues T1, T2 and the carbons C1 and C2 are removed by the spindles R4 and R2 and R3 and R1, respectively. The Step 2A shown in FIG. 10 and in FIG. 17 is accomplished by splitting the tear strips of form 10 as hereinbefore explained so as to permit the separation which results when Step 2A of FIG. 10 is terminated. In proceeding from Step 2A to 3A of FIG. 10 the stacks S16, S17, S18, S19 and S20 are inverted and presented in the order shown to the printer PR for the second printing. Upon termination of the second printing step 3A shown in FIG. 10 a stack of forms designated S9 results. The Step 4A shown in FIG. 10 is understood to involve the same decollation process as is shown in Step 5 of FIG. 9. Similarly, the Step 5A is a bursting step which is the same as Step 6 shown in FIG. 9 (see FIG. 16).

The process shown in FIG. 10 has advantages over that shown in FIG. 9 in that there is less handling of the stacks and certain procedural steps are eliminated. However, the process shown in FIG. 10 requires a more elaborate and expensive decollating machine D2 which embodies extra spindles and stacking compartments.

Preferably, in the processes shown in FIGS. 9 and 10, the tear strips 14 and 18 are not removed until the web W is fed through the burster BR whereupon they are both removed by engagement with slitter 45. It is desirable to leave both tear strips in place throughout processing to facilitate feeding of web W through the processing machines.

I claim:

1. A web comprising a plurality of manifold report forms, each manifold report form being joined to an adjacent manifold report form along an adjoining end edge, and a tear line transverse to said web along said adjoining end edge, each manifold report form comprising three superimposed and coextensive record sheets, namely top, middle and bottom record sheets, each record sheet having opposite lateral side edges and opposite end edges, each record sheet being provided with first and second perforate tear lines parallel to and adjacent opposite lateral side edges to define first and second tear strips, respectively, along the lateral side edges of the record sheets, said second tear lines being stronger than said first tear lines whereby said first tear lines separate first, means for mechanically joining together said first and second tear strips, respectively, pin feed holes in each of said tear strips, a first set of carbon papers comprising two first carbon papers arranged so that a first carbon paper is positioned between each adjacent pair of record sheets, one first carbon paper located between said top and middle record sheets having its carbon side facing said middle record sheet and the other first carbon paper having its carbon side facing said bottom record sheet, a second set of carbon papers comprising two second carbon papers arranged so that one second carbon paper is positioned between said one first carbon paper and said top record sheet and so that the other second carbon paper is positioned between said other first carbon paper and said middle record sheet, said one second carbon paper having its carbon side facing said top record sheet and said other second carbon paper having its carbon side facing said middle record sheet, a protective paper positioned between each second carbon paper and the adjacent record sheet, said first and second carbon papers and said protective papers being narrower than said record sheets, means for securing each of said first carbon papers and each protective paper along only one lateral side edge to said first tear strip, means for securing each of said second carbon papers along only one opposite lateral side edge to said second tear strip.

* * * * *